US008451693B2

(12) United States Patent
Nikoozadeh et al.

(10) Patent No.: US 8,451,693 B2
(45) Date of Patent: May 28, 2013

(54) MICROMACHINED ULTRASONIC TRANSDUCER HAVING COMPLIANT POST STRUCTURE

(75) Inventors: Amin Nikoozadeh, Burlingame, CA (US); Butrus T. Khuri-Yakub, Palo Alto, CA (US)

(73) Assignee: The Board of Trustees of the Leland Stanford Junior University, Palo Alto, CA (US)

( * ) Notice: Subject to any disclaimer, the term of this patent is extended or adjusted under 35 U.S.C. 154(b) by 397 days.

(21) Appl. No.: 12/806,763

(22) Filed: Aug. 20, 2010

(65) Prior Publication Data

US 2011/0050033 A1 Mar. 3, 2011

Related U.S. Application Data

(60) Provisional application No. 61/275,195, filed on Aug. 25, 2009.

(51) Int. Cl.
*H04R 19/00* (2006.01)
*B06B 1/02* (2006.01)

(52) U.S. Cl.
CPC ..... *B06B 1/0292* (2013.01)
USPC ..... 367/181

(58) Field of Classification Search
USPC ..... 367/181; 310/300
See application file for complete search history.

(56) References Cited

U.S. PATENT DOCUMENTS

| | | | | |
|---|---|---|---|---|
| 7,408,283 | B2 | 8/2008 | Smith et al. | |
| 2005/0228285 | A1 * | 10/2005 | Huang et al. | 600/459 |
| 2005/0234342 | A1 * | 10/2005 | Bayram et al. | 600/459 |
| 2006/0075818 | A1 * | 4/2006 | Huang et al. | 73/649 |
| 2007/0215964 | A1 * | 9/2007 | Khuri-Yakub et al. | 257/414 |
| 2008/0194053 | A1 * | 8/2008 | Huang | 438/53 |
| 2008/0197751 | A1 * | 8/2008 | Huang | 310/311 |
| 2008/0197754 | A1 * | 8/2008 | Roux et al. | 310/334 |
| 2009/0140606 | A1 * | 6/2009 | Huang | 310/322 |
| 2009/0167107 | A1 | 7/2009 | Huang | |

* cited by examiner

*Primary Examiner* — Isam Alsomiri
*Assistant Examiner* — James Hulka
(74) *Attorney, Agent, or Firm* — Lumen Patent Firm

(57) ABSTRACT

A compression post capacitive micromachined ultrasonic transducer (CMUT) is provided. The compression post CMUT includes a first electrode, a top conductive layer having a pattern of post holes, a moveable mass that includes the first electrode. The compression post CMUT further includes an operating gap disposed between the top surface of the top conductive layer and a bottom surface of the moveable mass, a pattern of compression posts, where a proximal end the compression post is connected perpendicularly to a bottom surface of the moveable mass, where the pattern of compression posts span through the pattern of post holes. The top conductive layer includes the second electrode that is electronically insulated from the first electrode, where the pattern of compression posts compress to provide a restoring force in a direction that is normal to the bottom surface of the moveable mass.

20 Claims, 9 Drawing Sheets

MICROMACHINED ULTRASONIC TRANSDUCER HAVING COMPLIANT POST STRUCTURE

CROSS-REFERENCE TO RELATED APPLICATIONS

This application claims priority from U.S. Provisional Patent Application 61/275,195 filed Aug. 25, 2009, which is incorporated herein by reference.

STATEMENT REGARDING FEDERALLY SPONSORED RESEARCH OR DEVELOPMENT

This invention was made with government support under GRANT # HL67647 awarded by National Institutes of Health, The U.S. government has certain rights in the invention.

FIELD OF THE INVENTION

The invention relates to capacitive micromachined ultrasonic transducers (CMUT). More specifically, the invention relates to CMUT's using a compression post structures for a restoring mechanism to a moveable mass.

BACKGROUND OF THE INVENTION

A conventional capacitive micromachined ultrasonic transducer (CMUT) device is composed of a membrane over a thin gap that is formed between the membrane and the substrate. The thickness and the lateral dimensions of the membrane as well as the membrane material properties determine the stiffness and the mass of the membrane and therefore, along with the gap height, determine important device parameters such as capacitance, collapse voltage, and frequency of operation. The membrane is tied on the edges to fixed post structures and it flexes in the space that is over the gap.

What is needed is a device that can be manufactured using well-established fabrication techniques of integrated circuits and Micro-Electro-Mechanical Systems, and relies on a substantially translational (piston-like) movement of the top plate as apposed to its deflection or bending in a conventional CMUT to generate a more average displacement of the top plate (and therefore surrounding medium) than in a conventional CMUT.

SUMMARY OF THE INVENTION

To address the needs in the art, a compression post capacitive micromachined ultrasonic transducer (CMUT) is provided. The compression post CMUT includes a first electrode, a top conductive layer having a pattern of post holes there through, a moveable mass disposed above a top surface of the top conductive layer, where the moveable mass includes the first electrode. The compression post CMUT further includes an operating gap disposed between the top surface of the top conductive layer and a bottom surface of the moveable mass, a pattern of compression posts, where a proximal end the compression post is connected perpendicularly to a bottom surface of the moveable mass, where the pattern of compression posts span through the pattern of post holes. The compression post CMUT further includes a second electrode, where the top conductive layer includes the second electrode, and the first electrode is electronically insulated from the second electrode, where the pattern of compression posts compress to provide a restoring force in a direction that is normal to the bottom surface of the moveable mass.

In one aspect of the invention, the movable mass includes an electronic circuit that operates the first electrode and the electronic circuit operates the second electrode, where the second electrode is connected to the top conductive layer.

According to anther aspect of the invention, the top conductive layer includes a transmit electrode and/or a receive electrode. In one aspect, the transmit electrode includes a transmit electrode gap between the transmit electrode and the moveable mass, where the receive electrode includes a receive electrode gap between the receive electrode and the moveable mass, where the transmit electrode gap is larger than the receive electrode gap.

In one aspect of the invention, an electronically insulating layer is disposed on the bottom surface of the moveable mass, where the electronically insulating layer is disposed between the compression post and the movable mass.

In a further aspect of the invention, an electronically insulating layer is disposed on a bottom surface of the compression post.

In yet another aspect of the invention, the compression post has a lower stiffness than the moveable mass, a higher stiffness than the moveable mass, or the same stiffness as the moveable mass.

According to another aspect of the invention, the top conductive layer is a device layer of silicon on insulator (SOI) wafer, wherein the SOI comprises a handle layer, an insulating layer and the device layer. In one aspect, the handle layer includes an electronic circuit that operates the first electrode connected to the movable mass, where the electronic circuit operates the second electrode connected to the device layer. In another aspect, the device layer includes an electronic circuit that operates the first electrode connected to the movable mass and the second electrode connected to the device layer.

According to anther aspect of the invention, the top conductive layer includes the second electrode.

In a further aspect of the invention, the moveable mass includes a plate having a pattern of features disposed therein or pattern of features disposed thereon.

In another aspect of the invention, the compression post has a cross-section shape that can include a circle, a circle with varying thickness along the length of the compression post, a ring, an oval, a hollow oval, a polygon, a hollow polygon, a cross, or a rectangle.

According to another aspect of the invention, the compression post CMUT further includes a comb drive having a plate connected normal to the bottom surface of the moveable mass, where the plate is disposed in a trench formed in the top conductive layer, where the plate is separated from the top conductive layer by a plate gap within the trench.

In yet another aspect of the invention, the top conductive layer includes a pattern of secondary post holes, where a pattern of secondary compression posts are disposed in the secondary post holes. In one aspect, the secondary compression posts have a length spanning from a bottom of the secondary post holes to within the operating gap. In another aspect, the secondary compression posts have a length spanning from a bottom of the secondary post holes to a moveable mass cavity disposed in a bottom surface of the movable mass.

In a further aspect of the invention, the movable mass includes another the compression post CMUT disposed thereon, or an electronic device disposed thereon.

According to another aspect, the invention further includes a bottom conductive layer that is electronically insulated from the top conducting layer, where the bottom conductive layer includes an electronic circuit that operates the first electrode connected to the movable mass and operates the second electrode connected to the top conductive layer.

In another aspect of the invention, the top conductive layer includes an electronic circuit that operates the first electrode connected to the movable mass and operates the second electrode connected to the top conductive layer.

DETAILED DESCRIPTION

A compression post capacitive micromachined ultrasonic transducer (CMUT) is provided. The operation of this transducer includes a compression post structure that provides a restoring force to a moveable mass that is perpendicular to the surface of the moveable mass, where the device relies on the compression of the post structure rather than the flexure of the top plate. According to an embodiment of the invention, the top plate is a moveable mass that transfers the force/pressure exerted on the plate to the post structure. The movement of the compression post structure is then reflected in the movement of the moveable mass and vice versa. Therefore, in the transmit mode an electrostatic force applied across a first and a second electrodes, where the first electrode is included in the moveable mass, that generates translational movement in the moveable mass and hence an ultrasound wave is generated in the surrounding medium. In reception mode, the applied ultrasound wave on the moveable mass creates translational movement in the moveable mass that can be detected.

The movement of the compression post structure can be explained by Hooke's law, which states that the stress is proportional to the strain with the proportionality factor being the elastic constant of the material. In the case where the post is a thin rod the relevant coefficient of elasticity is the Young's Modulus of the post.

According to the invention, the transducer can be designed for parallel plate or comb-drive electrostatic actuators. To operate in the parallel plate mode a thin gap is provided between the moveable mass and a second fixed electrode. In one embodiment, the electrostatic force is applied between the moveable mass and a substrate.

For the comb-drive mode, trenches are provided in a substrate and additional plates are attached perpendicularly to the moveable mass and extended into the trenches. Here the electrostatic force is applied between the additional plates extending from the moveable mass and the substrate.

The moveable mass can be patterned to, for example, improve the frequency response.

This invention may be used in any applications where ultrasound transducers are employed. The operation of the device relies on the substantially translational (piston-like) movement of the moveable mass and compression of the posts within the post ports, without deflection or bending of the posts. This piston-like movement generates more average displacement of the moveable mass (and therefore surrounding medium) than in a conventional CMUT.

Figure 1:
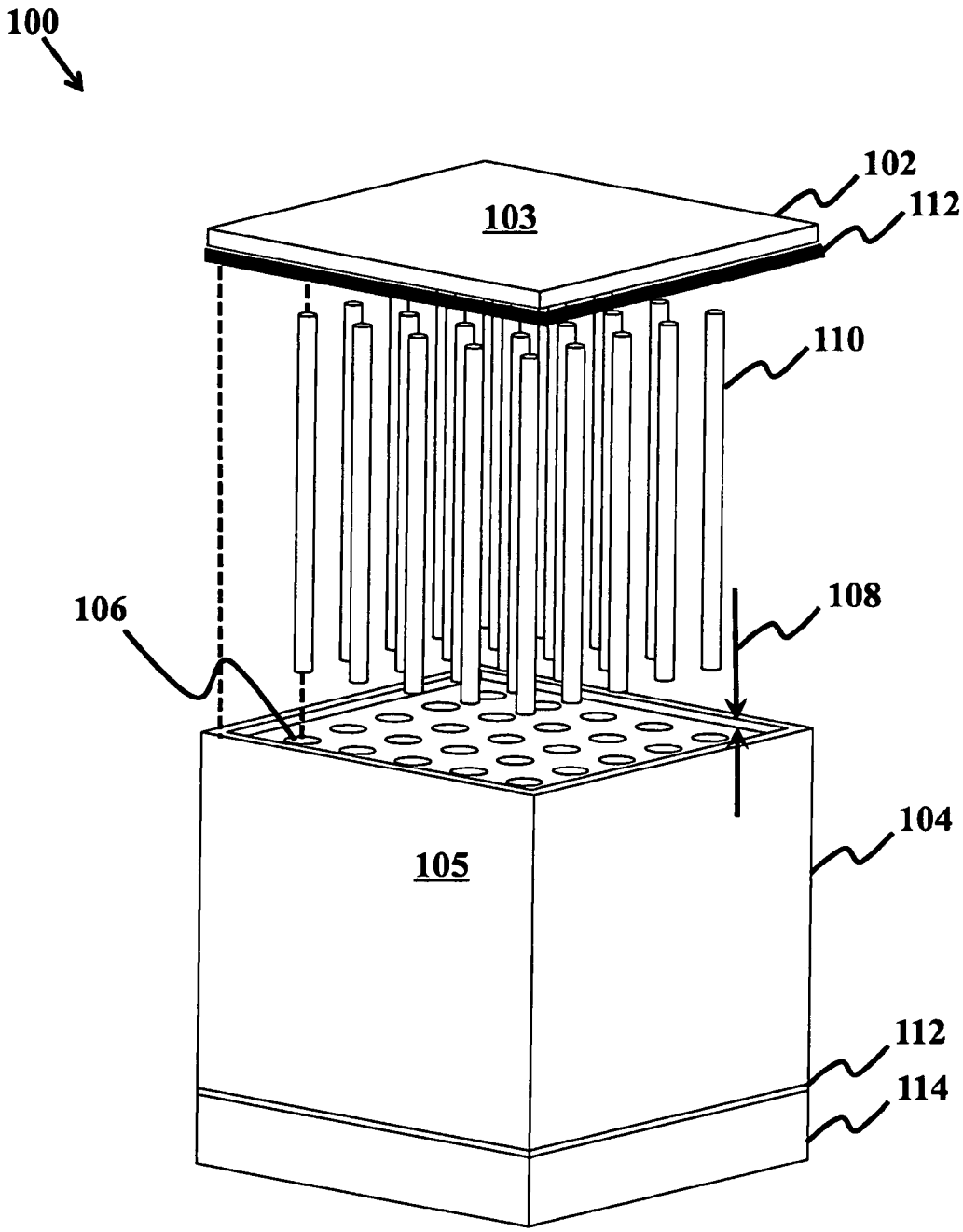
FIG. 1 shows a perspective exploded view of a compression post CMUT having a pattern of compression posts, according to an embodiment of the invention.
Figure 2:
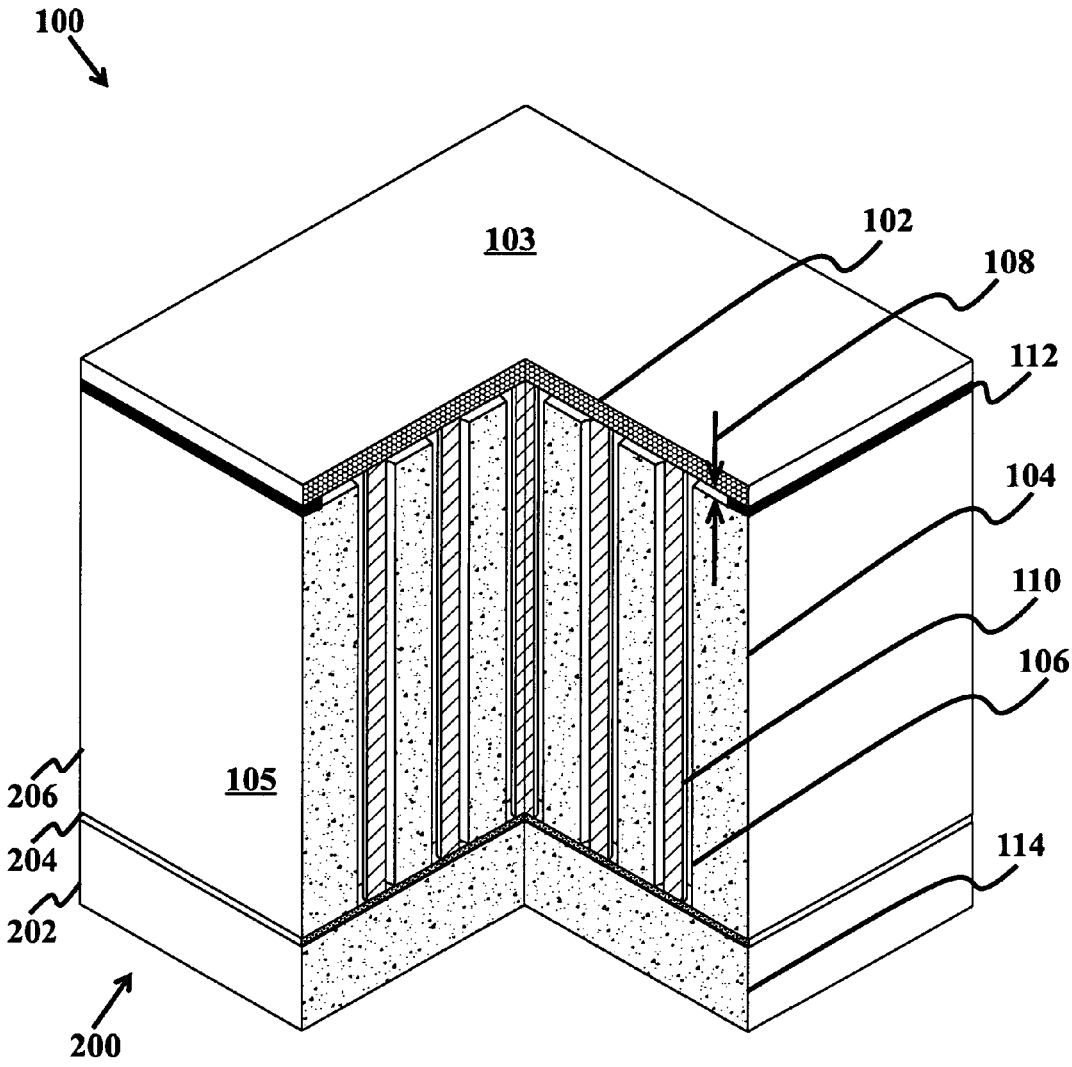
FIG. 2 shows a perspective cutaway view of a compression post compression post CMUT having a pattern of compression posts, according to an embodiment of the invention.

Referring now to the figures, FIG. 1 shows a perspective exploded view of a compression post CMUT 100, according to an embodiment of the invention. The compression post CMUT 100 includes a moveable mass 102 that serves as a first electrode 103 when formed partially or entirely from electronically conductive material, a top conductive layer 104 having a pattern of post holes 106 there through and includes a second electrode 105, the moveable mass 102 is disposed above a top surface of the top conductive layer 104. The compression post CMUT 100 further includes an operating gap 108 disposed between the top surface of the top conductive layer 104 and a bottom surface of the moveable mass 102, and a pattern of compression posts 110. As shown in FIG. 2, a proximal end the compression post 110 is connected perpendicularly to a bottom surface of the moveable mass 102, and the pattern of compression posts 110 span through the pattern of post holes 106. The top conductive layer 104 includes the second electrode 105 when formed entirely or partially from an electronically conductive material, and the first electrode 103 is electronically insulated from the second electrode 105, where the embodiments shown in FIG. 1 and FIG. 2 show an insulating layer 112, such as an oxide layer, disposed between the moveable mass 102 and the top conductive layer 104, where the insulating layer 112 can be disposed on the bottom surface of the moveable mass 102 or on the supporting edge of the top conductive layer 104. Further shown in FIG. 1 and FIG. 2 is the top conductive layer 104 disposed on a substrate 114, where the top conductive layer 104 is separated from the substrate 114 by the insulating layer 112 when the substrate 114 is formed using a conductive material, and the insulating layer 112 is not needed when the substrate 114 is a non-conducting material. In operation, the pattern of compression posts 110 compress to provide a restoring force in a direction that is normal to the bottom surface of the moveable mass 102. According to an embodiment of the invention, the moveable mass 102 can be made of materials such as silicon, polysilicon, silicon nitride, diamond, oxide, LTO, silicon carbide, glass, quartz, sapphire, fused silica, alumina, aluminum nitride, parylene, PMMA, PDMS, polymer, or metal. Further, the substrate 114 can be made from materials such as silicon, silicon carbide, glass, quartz, sapphire, fused silica, alumina, aluminum nitride, parylene, PMMA, PDMS, or polymer.

FIG. 2 shows a perspective cutaway view of a compression post CMUT 100 having the pattern of compression posts 110. According to one embodiment of the invention, the compression post CMUT 100 is formed using a silicon on insulator (SOI) wafer 200 having a handle layer 202, a buried oxide layer 204 and a device layer 206, where the current embodiment has the top conductive layer 104 formed from the device layer 206 the SOI wafer 200. FIG. 2 further shows the operating gap 108 disposed between the top surface of top conductive layer 104, with the conductive moveable mass 102 separated from the top conductive layer 104 by an insulating layer 112, which can be an oxide layer disposed on the bottom surface of moveable mass 102 or on the outer perimeter of the top conductive layer 104. An electric field is established between a first electrode 103 in the moveable mass 102 and a second electrode 105 in the top conductive layer 104 to move the moveable mass 102 in a direction that compresses the compression posts 110 without bending, where the compression posts 110 provide a restoring force in the opposite direction.

Figure 3:
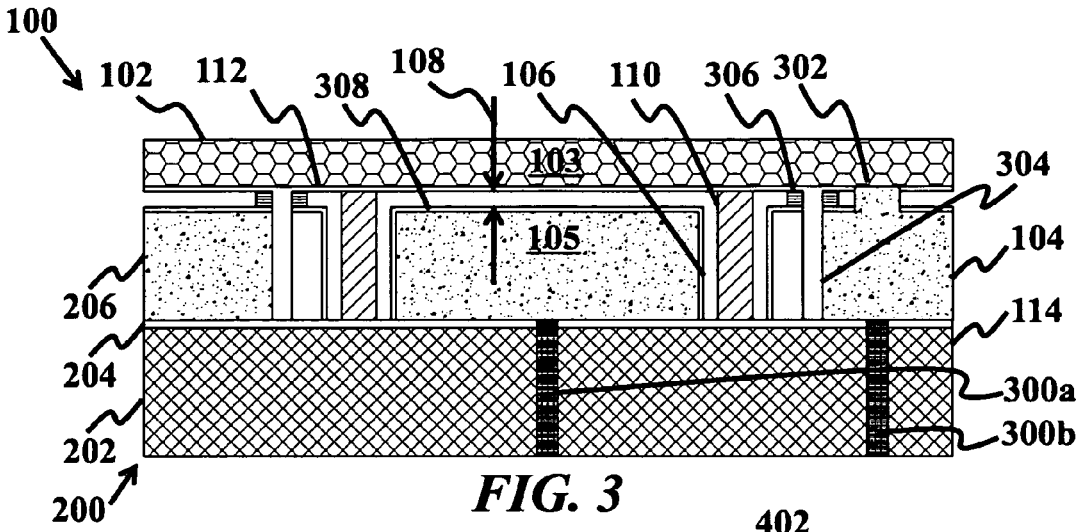
FIG. 3 shows a planar cutaway view of a compression post CMUT having a first electrode disposed in the moveable mass and a second electrode disposed in the top conductive layer, according to an embodiment of the invention.

FIG. 3 shows one embodiment of the invention having a planar cutaway view of a unit cell of the compression post CMUT 100. In this example, because the moveable mass 102 is conductive it serves as the first electrode 103 and because the top conductive layer 104 is conductive it serves as the second electrode 105, where the moveable mass 102 and the top conductive layer 104 are separated by the operating gap 108. The compression post CMUT 100 is shown formed on the SOI wafer 200 where conductive vias 300 (*a*) and 300 (*b*) are disposed through the handle layer 202 and through the buried oxide layer 204 and into the top conducting layer 104 formed in the device layer 206, where the conductive vias 300 (*a*) and 300 (*b*) are electronically connecting and conduct to the top conductive layer 104 forming the second electrode and the conductive moveable mass 102 forming the first electrode 103, respectively, where the conductive path from the conductive via 300 (*b*) to the conductive moveable mass 102 is provided by a conductive edge element 302 which conducts from the top conductive layer 104 to the conductive moveable mass 102. FIG. 3 further shows the first electrode 103 and second electrode 105 disposed in the conductive moveable mass 102 and the top conductive layer 104, respectively, are electronically isolated from each other using trenches 304 formed in the top conductive layer 104, and/or by insulating layers 112, such as oxide layers, disposed on the bottom surface of the conductive moveable mass 102, and/or disposed on the top surface of the top conducting layer 104, and/or disposed on the walls of the compression post holes 106. Here, the insulating layer on the top of the top conductive layer 102 and the walls of the compression post holes 106 could be removed and still the two electrodes are electrically isolated. In this example, the substrate 114 is a non-conducting material and the conductive moveable mass 102 is supported by insulating edge supports 306. In a further aspect of the invention, an electronically insulating layer 112 is disposed on a bottom surface of the compression post 110. In one aspect of the invention, the compression post 110 has a lower stiffness than the moveable mass 102, a higher stiffness than the moveable mass 102, or the same stiffness as the moveable mass 102. In a further aspect the top conductive layer 104 has an insulating layer 308 disposed on the surface and surfaces of the features that includes the compression post holes 106. Here, the stiffness of the moveable mass 102 can be used to alter/optimize the device performance, for example, by careful selection of the relative stiffness, the device can operate at one desired frequency band, based on the post compression, and operate at another desired frequency band based on the moveable mass 102 bending/flexing. The two bands can be overlapped to have a very wide-band device, where the stiffness of the compression post 110 and the stiffness of the moveable mass 102 are chosen to optimize the response of the transducer 100, namely to enhance the bandwidth, output pressure, and receive sensitivity. It is understood that electrical connections may be provided through the handle layer 202. Separated pillars in the conductive handle layer 202 can be disposed to provide individual electrical connections, where the pillars are formed using trenches or the like to isolate the connections to the electrodes 103/105 through the back side of the device 100 in the handle layer 202.

Consider the unit-cell is shown in FIG. 3 with the compression post 110 connected to the moveable mass 102. The force applied to the moveable mass 102 compresses the compression post 110, operating as a compliant element. This unit-cell can be modeled as a mass-spring model. In an example where the moveable mass 102 is more rigid than the compression post 110, the spring constant is determined by the spring constant of the compression post 110. The effective mass of the moveable mass 102 along with the effective mass of the compression post 110 constitute an effective mass in this example. To derive the spring constant, the mass, and the resonant frequency of the system, the following description is provided. The physics describing the movement of the post structure can be explained by Hooke's law, which states that the stress is proportional to the strain with the proportionality factor being the elastic constant of the material. In an example where the compression post 110 is a thin rod the relevant coefficient of elasticity is the Young's Modulus of the post $$T = ES \Rightarrow \frac{F}{A_{post}} = E\frac{x}{h_{post}} \Rightarrow F = \frac{E \times A_{post}}{h_{post}}x$$

E is the Young's Modulus of the material of the compression post 110, and T and S are stress and strain, respectively. $A_{post}$ and $h_{post}$ denote the cross-sectional area and height of the compression post 110, respectively. The final expression relates the force (F) to the displacement (x), and the coefficient of proportionality denotes the spring constant (k). Therefore, $$k = \frac{E \times A_{post}}{h_{post}}$$

It is seen from this expression that the spring constant is inversely proportional to the height of the compression post 110 and it is proportional to the cross-sectional area of the compression post 110.

The total mass is determined by the effective mass of the moveable mass 102 and the compression post 110.

$$m_{total} = m_{moveable\ mass} + m_{compression\ post}$$

Using the expressions for the spring constant and the mass, one can derive the resonant frequency of the structure.

$$f_0 = \frac{1}{2\pi}\sqrt{\frac{k}{m_{total}}}$$

Using the expressions derived above, one can estimate the values of k, m, and $f_o$ for frequency range 1-100 MHz (medical imaging). In this discussion, the moveable mass is identified as a top plate and the compression post is identified as a post. Further, for this discussion both the top plate and the post are made of silicon (E=168 GPa, ρ=2332 kg/m$^3$). Assume that the effective mass of the post is 0.4 times the mass of the post (0.4 is an empirical number coming from FEA simulations). Table I summarizes several different exemplary designs. The resonant frequency in Table I denotes the open-circuit resonant frequency of the device. The short-circuit resonant frequency will be lower depending on the applied DC bias. The minimum and maximum values in each column are highlighted. Also note that the spring constant and the mass in Table I denote the corresponding values only for a single unit-cell that includes a single post with a disk-shape top plate free on the edges. Since a transducer element is composed of several unit-cells, the overall spring-constant and the mass for an element will be the product of the corresponding number for a unit-cell and the number of unit-cells that make up the element.

The operating gap (hgap) 108 may vary depending on the design and it could range from several nanometers to several micrometers. The width of the post ports 106 around the posts is desired to be as small as possible, and ranges from a few tens of nanometers to a few micrometers. The post height ranges from 3.3 μm to 347 μm and the post aspect ratio ranges from 3.3 to 69.4.

TABLE 1

| Design | Plate Diameter (μm) | Plate Thickness (μm) | Post Diameter (μm) | Post Height (μm) | Post Aspect Ratio | Spring Constant (×10$^3$ N/m) | Effective Mass (×10$^{-12}$ kg) | Resonant Frequency (MHz) |
|---|---|---|---|---|---|---|---|---|
| 1 | 80 | 20 | 5 | 347.00 | 69.40 | 9.51 | 240.79 | 1 |
| 2 | 80 | 20 | 5 | 88.49 | 17.7 | 37.28 | 236.06 | 2 |
| 3 | 80 | 20 | 5 | 22.24 | 4.45 | 148.34 | 234.85 | 4 |
| 4 | 60 | 10 | 5 | 77.53 | 15.51 | 42.55 | 67.36 | 4 |
| 5 | 50 | 10 | 5 | 28.19 | 5.64 | 117.00 | 46.31 | 8 |
| 6 | 50 | 10 | 5 | 18.12 | 3.62 | 182.08 | 46.12 | 10 |
| 7 | 40 | 5 | 5 | 53.45 | 10.69 | 61.71 | 15.63 | 10 |
| 8 | 30 | 5 | 5 | 85.23 | 17.05 | 38.70 | 9.80 | 10 |
| 9 | 30 | 5 | 5 | 24.06 | 4.81 | 137.11 | 8.68 | 20 |
| 10 | 20 | 5 | 5 | 46.3 | 9.26 | 71.24 | 4.51 | 20 |
| 11 | 20 | 5 | 4 | 15.46 | 3.86 | 136.59 | 3.84 | 30 |
| 12 | 10 | 2 | 4 | 40.01 | 10.00 | 52.76 | 0.84 | 40 |
| 13 | 10 | 2 | 4 | 29.86 | 7.47 | 70.70 | 0.72 | 50 |
| 14 | 10 | 2 | 4 | 23.25 | 5.81 | 90.80 | 0.64 | 60 |
| 15 | 10 | 2 | 4 | 18.66 | 4.66 | 113.16 | 0.58 | 70 |
| 16 | 10 | 1 | 3 | 16.21 | 5.40 | 73.28 | 0.29 | 80 |
| 17 | 10 | 1 | 3 | 13.61 | 4.54 | 87.26 | 0.27 | 90 |
| 18 | 10 | 1 | 3 | 11.59 | 3.86 | 102.47 | 0.26 | 100 |
| 19 | 10 | 1 | 2 | 6.6 | 3.30 | 79.94 | 0.20 | 100 |
| 20 | 5 | 1 | 2 | 14.93 | 7.47 | 35.35 | 0.09 | 100 |
| 21 | 5 | 0.5 | 2 | 17.81 | 8.9 | 29.64 | 0.08 | 100 |
| 22 | 5 | 0.5 | 2 | 10.86 | 5.43 | 48.60 | 0.05 | 150 |
| 23 | 5 | 0.5 | 2 | 7.47 | 3.73 | 70.7 | 0.04 | 200 |
| 24 | 5 | 0.5 | 1 | 3.3 | 3.30 | 39.97 | 0.03 | 200 |
| 25 | 3 | 0.5 | 1 | 6.45 | 6.45 | 20.47 | 0.01 | 200 |

Figure 4:
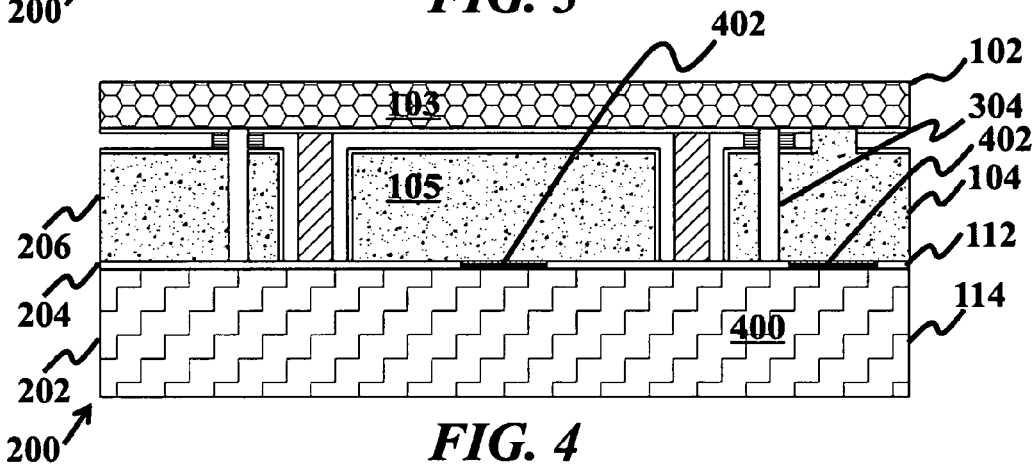
FIG. 4 shows a planar cutaway view of a compression post CMUT having a first electrode disposed in the moveable mass and a second electrode disposed in the top conductive layer and electronics disposed in a handle layer of an SOI wafer, according to an embodiment of the invention.

FIG. 4 shows a planar cutaway view of another embodiment of the compression post CMUT 100 having electronics 400 disposed in the substrate 114, or in a handle layer 202 of an SOI wafer 200, according to an embodiment of the invention. In this embodiment, the electronics 400 operate the first electrode 103 connected to the movable mass 102, and operate the second electrode 105 connected to the device layer 206 having the top conductive layer 104 formed therein. The electronics 400 are disposed to control the electrical signal provided to the electrodes through the conductive paths 402 disposed through the insulating layer 112 or buried oxide layer 204. In this embodiment, the handle layer 202 is a bottom conductive layer that is electronically insulated from the top conducting layer 104, where the handle layer 202 includes the electronics 400.

Figure 5:
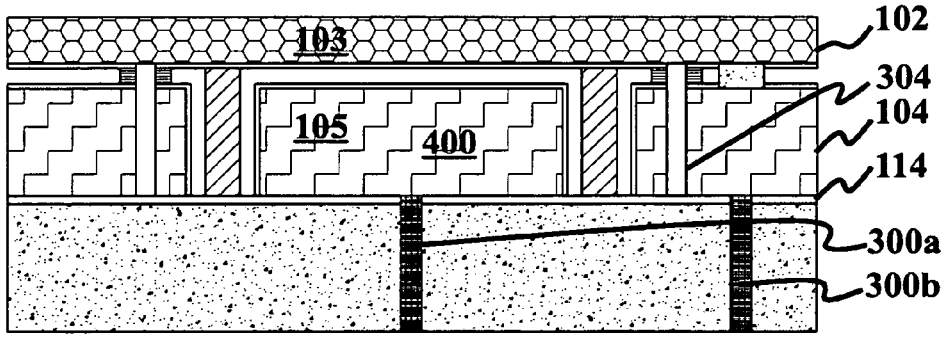
FIG. 5 shows a planar cutaway view of a compression post CMUT having a first electrode disposed in the moveable mass and a second electrode disposed in the top conductive layer and electronics disposed in the top conductive layer, according to an embodiment of the invention.

FIG. 5 shows a planar cutaway view of one embodiment of the compression post CMUT 100 with a first electrode 103 disposed in the moveable mass 102, a second electrode 105 disposed in the top conductive layer 104 and electronics 400 disposed in the top conductive layer 104. Here, conductive vias 300 (*a*) and 300 (*b*) are provided through the insulating layer 112 or the buried oxide layer 204 and through the substrate layer 114 or the handle layer 206, where the substrate layer 114 and handle layer 206 may or may not be electronically conductive layers. The electronics 400 are disposed to control the electrical signal provided to the electrodes.

Figure 6:
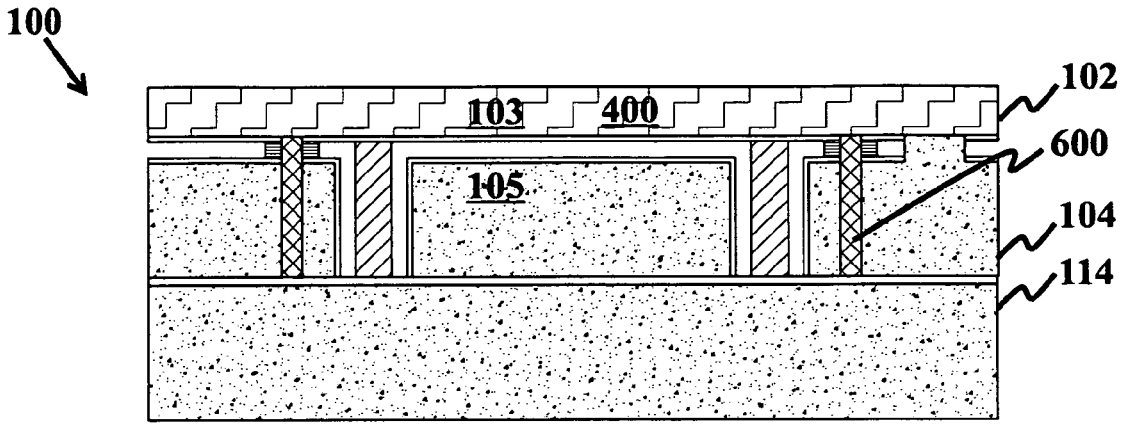
FIG. 6 shows a planar cutaway view of a compression post CMUT having a first electrode disposed in the moveable mass and a second electrode disposed in the top conductive layer and electronics disposed in the moveable mass, according to an embodiment of the invention.

FIG. 6 shows a planar cutaway view of a further embodiment of the compression post CMUT 100 where the movable mass 102 includes an electronic circuit 400 that operates the electrodes, where the second electrode 105 is in the top conductive layer 104. In this exemplary embodiment, the isolation trenches 304 of the embodiments shown in FIGS. 3-5 are shown as crosshatched markings 600 to indicate that they may be made conductive to allow actuation between the two electrodes.

According to the invention, a transducer array includes multiple elements 100. Every element 100 has two electrodes 103/105, with one of the electrodes disposed common among all the elements 100. The other electrode of each element 100 needs to be separated from all the other elements 100. As shown in FIG. 3 through FIG. 5, the common electrode 103 to all the elements 100 is included in the movable mass 102 to provide a continuous electrically-common electrode 103 to all the elements 100. The other electrode 105 included in the top conductive layer 104 is separated for each element 100, for example by the trenches 304 shown in FIG. 3 through FIG. 5. The trenches 304 are not necessary if individual electrodes 105 are provided in the top portion of the top conductive layer 104 (e.g. a patterned conductive poly-silicon layer on the top surface). According to the invention, the top conductive layer 104 is disposed to include the individual electrodes 105 when the electrical connections are provided through the backside of the device 100. In a further aspect, for a 1-D array, it may not be desirable for backside connections. If front-side connections are desirable, an electrode 105 disposed in the top conductive layer 104 provides the common electrode (i.e. no trenches 304), instead separate the electrodes 103 in the movable mass 102 (e.g. separating them using trenches in the movable mass) may be provided.

Referring again to FIG. 6, the electronics 400 are disposed to at least control the individual electrodes 103/105. The common electrode would have a common voltage (e.g. grounded). Therefore with the electronics 400 disposed in the movable mass 102, it may be desirable to provide movable mass 102 with the individual electrodes 103/105 and therefore the trenches 304 shown in FIG. 3 through FIG. 5 are not necessary as shown by the crosshatch trenches 600 in FIG. 6, since the top conductive layer 104 carries the common electrode.

Figure 7:
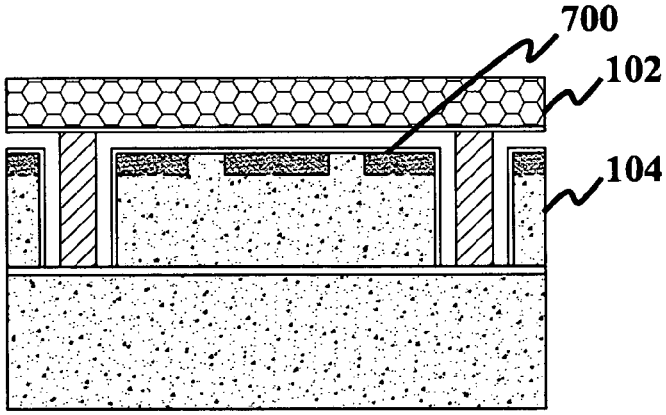
FIG. 7 shows a planar cutaway view of a compression post CMUT having transmit and/or receive electrodes disposed in the top conductive layer, according to an embodiment of the invention.

FIG. 7 shows a planar cutaway view of one embodiment of the compression post CMUT 100 with transmit and/or receive electrodes 700 disposed in the top conductive layer 104.

Figure 8:
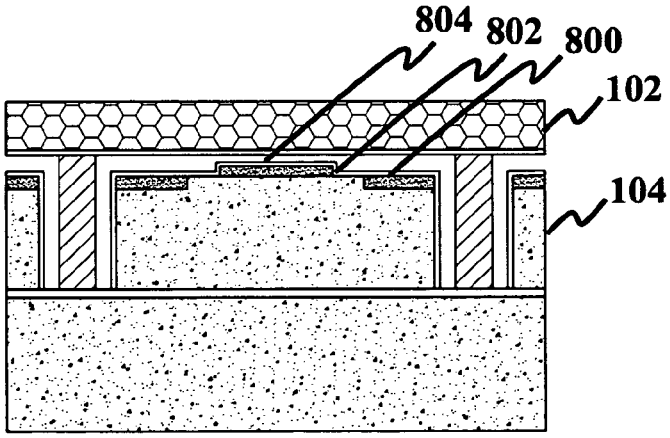
FIG. 8 shows a planar cutaway view of a compression post CMUT having transmit electrodes and a receive electrode disposed on the top conductive layer that extends in the operating gap, according to an embodiment of the invention.

FIG. 8 shows a planar cutaway view of one embodiment of the compression post CMUT 100 with transmit electrodes 800 in the top conductive layer 104 and a receive electrode 802 disposed on an extended top conductive feature 804 of the top conductive layer 104 that extends in the operating gap 108.

Figure 9:
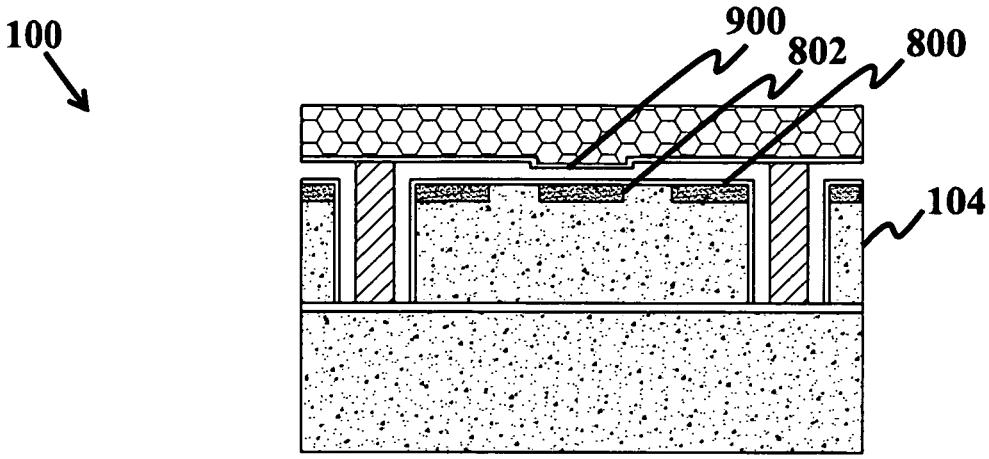
FIG. 9 shows a planar cutaway view of a compression post CMUT having transmit electrodes and a receive electrode disposed in the top conductive layer and a portion of the moveable mass extending into the operating gap above the receive electrode, according to an embodiment of the invention.

FIG. 9 shows a planar cutaway view of another embodiment of the compression post CMUT 100 with transmit electrodes 800 and a receive electrode 802 disposed in the top conductive layer and an extended moveable mass feature 900 of the moveable mass 102 that extends into the operating gap 108 above the receive electrode 802.

Figure 10:
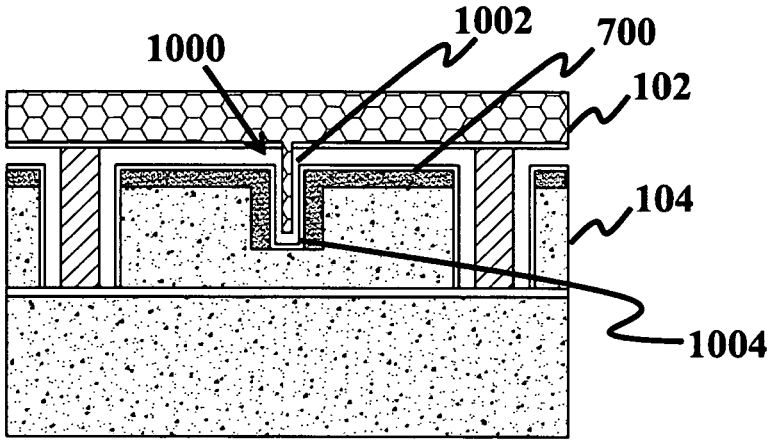
FIGS. 10-11 show planar cutaway views of compression post CMUT's having transmit and/or receive electrodes disposed in the top conductive layer and a plate connected normal to the bottom surface of the moveable mass, according to an embodiment of the invention.
Figure 11:
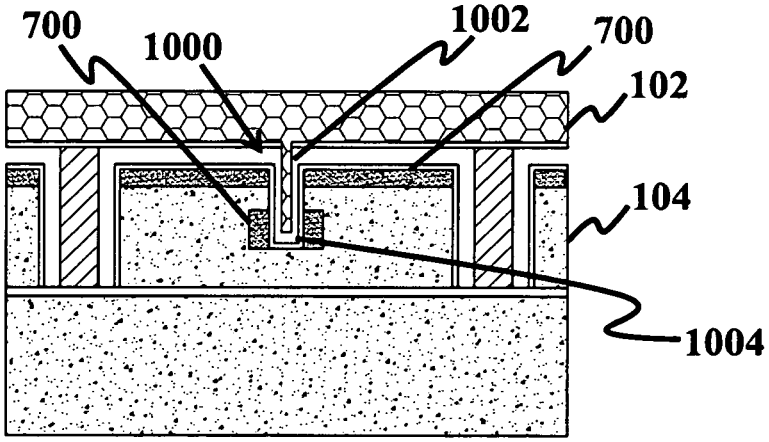

FIG. 10 and FIG. 11 show a planar cutaway view of the compression post CMUT 100 with transmit and/or receive electrodes 700 disposed in the top conductive layer 104. In this embodiment there is a comb-drive actuator 1000 that includes a conductive plate 1002 disposed in a trench 1004 formed in the top conductive layer 104. The conductive plate 1002 is connected normal to the bottom surface of the moveable mass 102. As shown, the plate 1002 is separated from the top conductive layer 104 by a plate gap 1006 within the trench 1004. FIG. 11 further shows the top conductive layer 104 having separated transmit and/or receive electrodes 700 disposed on each side of the plate 1002.

Figure 12:
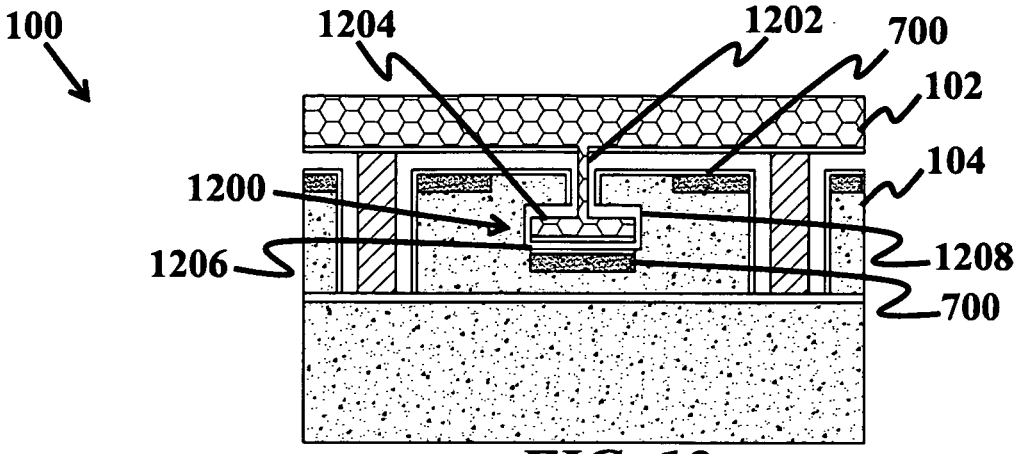
FIG. 12 shows a planar cutaway view of a compression post CMUT having transmit electrodes and a receive electrode disposed in the top conductive layer and an additional parallel electrostatic actuator, according to one embodiment of the invention.

FIG. 12 shows a planar cutaway view of another embodiment of the compression post CMUT 100 with the transmit and/or receive electrodes 700 disposed in the top conductive layer 104 and an additional parallel electrostatic actuator 1200. Here a connective element 1202 is connected to the moveable mass 102 and to a plate 1204, where the plate 1204 is disposed above a plate gap 1206 formed by a cavity 1208 in the top conductive layer 104, and a transmit and/or receive electrode 700 is disposed in the top conductive layer 104 and below the plate gap 1204.

Figure 13:
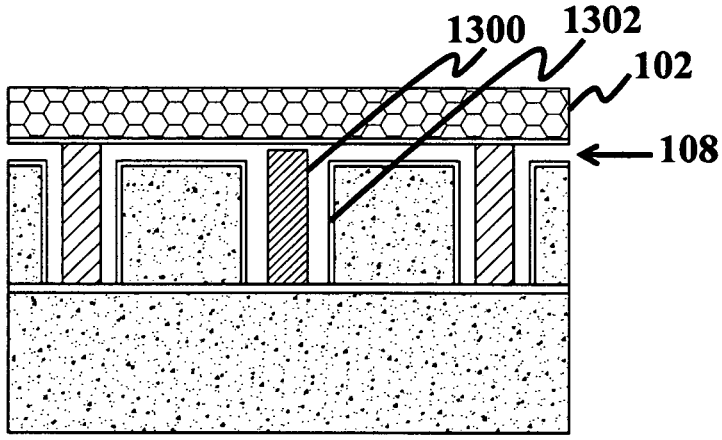
FIG. 13 shows a planar cutaway view of a compression post CMUT having a multi-frequency structure that includes secondary compression posts with a length spanning into the operating gap, according to an embodiment of the invention.
Figure 14:
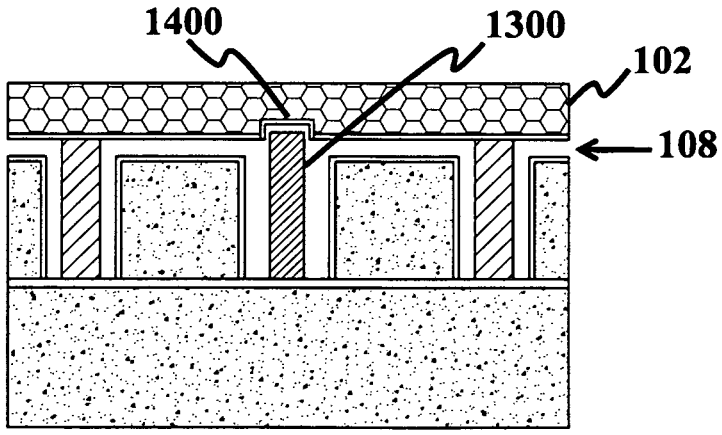
FIG. 14 shows a planar cutaway view of a compression post CMUT having a multi-frequency structure that includes secondary compression posts with a length spanning into a cavity disposed in a bottom surface of the movable mass, according to an embodiment the present invention.

FIG. 13 and FIG. 14 show planar cutaway views of embodiments of the compression post CMUT 100 with a multi-frequency structure. As shown in FIG. 13 the structure includes a pattern of secondary compression posts 1300 with a length spanning into the operating gap 108, that are disposed in a pattern of secondary post holes 1302. FIG. 14 shows a multi-frequency structure that includes secondary compression posts with a length spanning into a cavity 1400 disposed in a bottom surface of the movable mass 102, according to the present invention.

Figure 15:
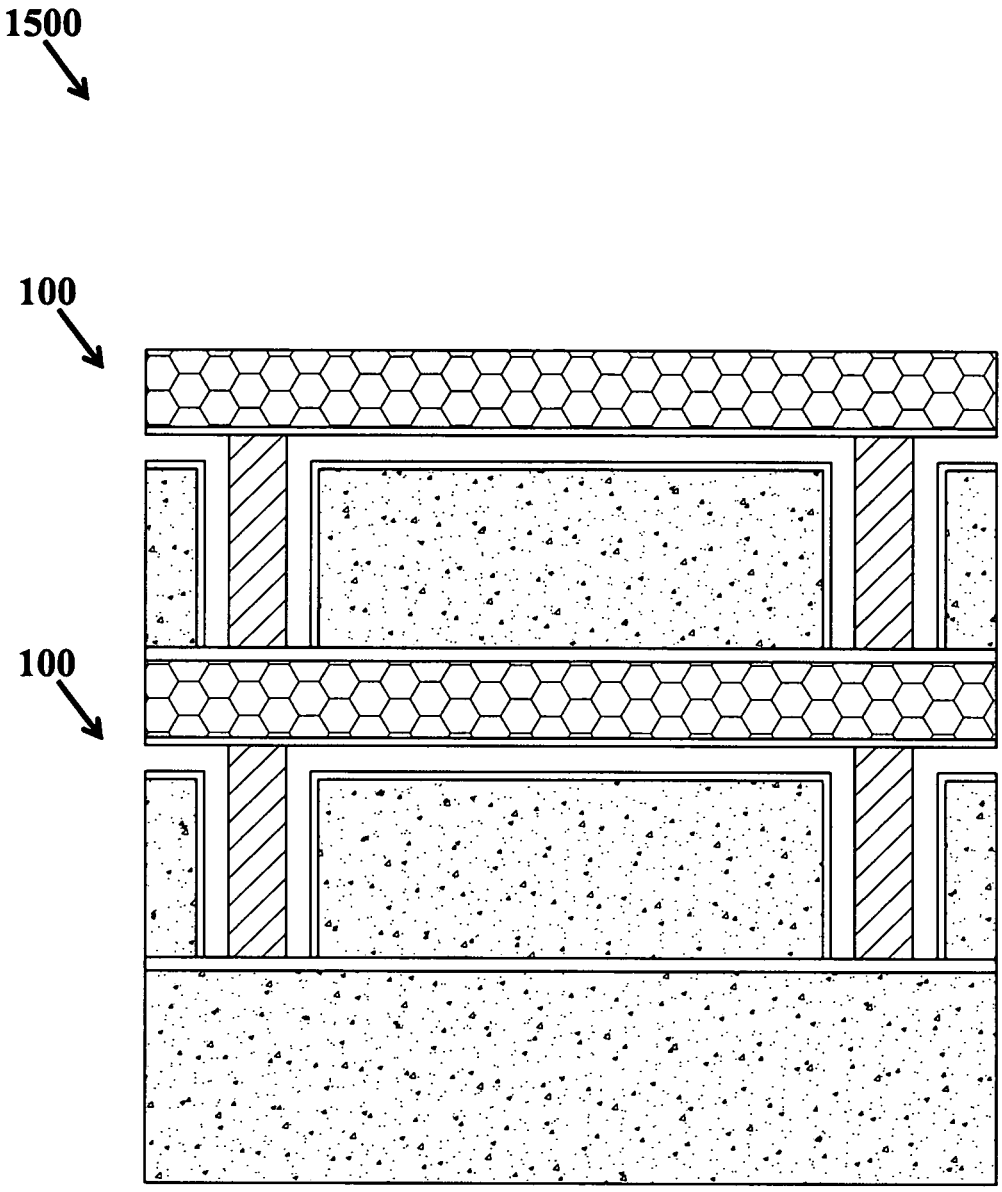
FIG. 15 shows a planar cutaway view of a stack of compression post CMUT's, according to an embodiment of the invention.

FIG. 15 shows a planar cutaway view of a stack of compression post CMUTs 100, according to an embodiment of the invention.

Figure 16:
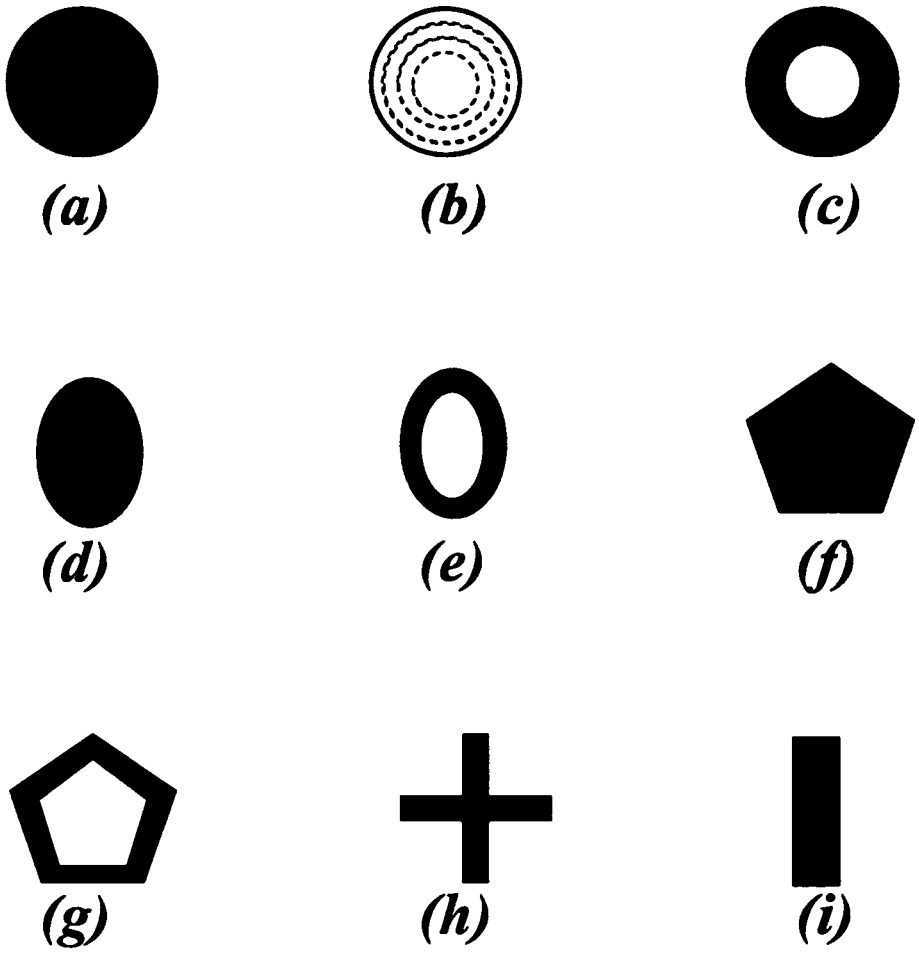
FIGS. 16*a*-16*i* show cross-section views of exemplary compression posts, according to an embodiment of the invention.

FIGS. 16*a*-16*i* show cross-section views of exemplary compression posts, according to an embodiment of the invention. As shown, the compression post has a cross-section shape that can include a circle (FIG. 16*a*), a circle with varying thickness along the length of the compression post (FIG. 16*b*), a ring (FIG. 16*c*), an oval (FIG. 16*d*), a hollow oval (FIG. 16*e*), a polygon (FIG. 16*f*), a hollow polygon (FIG. 16*g*), a cross (FIG. 16*h*), or a rectangle (FIG. 16*i*).

Figure 17:
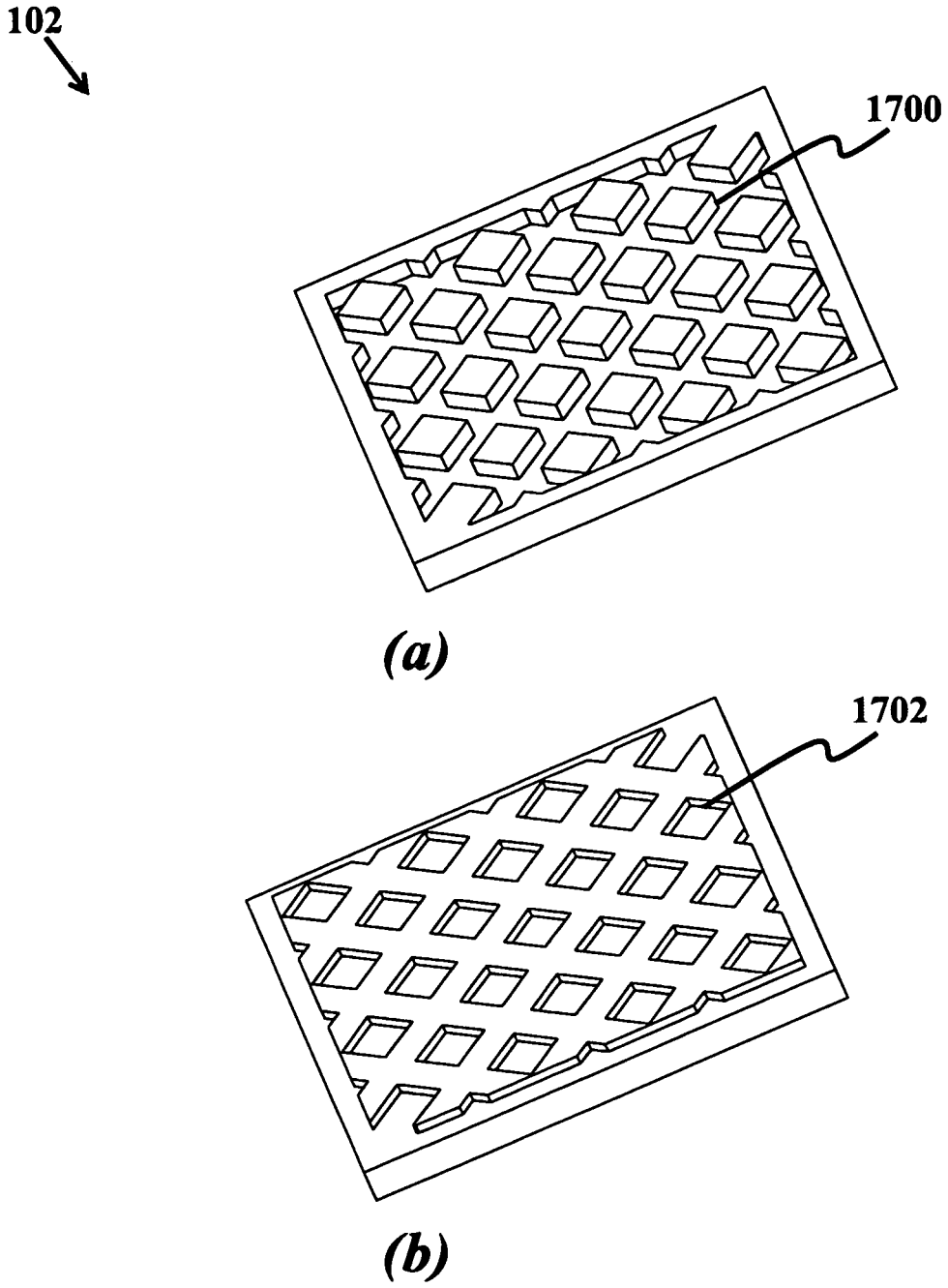
FIGS. 17*a*-17*b* show perspective views of the moveable mass having features in and on the moveable mass, respectively, according to an embodiment of the invention.

FIGS. 17*a*-17*b* show perspective views of the moveable mass having a pattern features in 1700 (FIG. 17*a*) and a pattern of features on 1702 (FIG. 17*b*) the moveable mass 102, respectively, according to an embodiment of the invention.

The present invention has now been described in accordance with several exemplary embodiments, which are intended to be illustrative in all aspects, rather than restrictive. Thus, the present invention is capable of many variations in detailed implementation, which may be derived from the description contained herein by a person of ordinary skill in the art. For example the movable mass 102 could include other devices, such as a temperature sensor, another ultrasound transducer for HIFU (high-intensity focused ultrasound) applications, etc. Further, the compression post pattern can be non-uniform across the device 100 to alter/optimize the response of the device, where the width or the length of the posts 110 could vary within the device 100, the spacing between the posts 110 could vary within the device 100, and even the cross-sectional shape of the posts 110 may be a mix of one or more post shapes described above.

All such variations are considered to be within the scope and spirit of the present invention as defined by the following claims and their legal equivalents.

What is claimed:

1. A compression post capacitive micromachined ultrasonic transducer (CMUT), comprising:

a. a first electrode b. a top conductive layer, wherein said top conductive layer comprises a pattern of post holes there through, wherein said top conductive layer comprises a device layer of a silicon on insulator (SOI) wafer, wherein said post holes terminate at a buried oxide layer in said SOI wafer, wherein said buried oxide layer is disposed on a handle of said SOI;

c. a moveable mass disposed above a top surface of said top conductive layer, wherein said moveable mass comprises said first electrode;

d. an operating gap, wherein said operating gap is disposed between said top surface of said top conductive layer and a bottom surface of said moveable mass;

e. a pattern of compression posts, wherein a proximal end said compression post is connected perpendicularly to a bottom surface of said moveable mass, wherein said pattern of compression posts span through said pattern of post holes; and f. a second electrode, wherein said top conductive layer comprises said second electrode, wherein said first electrode is electronically insulated from said second electrode, wherein said pattern of compression posts compress on said buried oxide layer without bending to provide a restoring force in a direction that is normal to said bottom surface of said moveable mass.

2. The compression post CMUT of claim 1, wherein said movable mass comprises an electronic circuit, wherein said electronic circuit operates said first electrode, wherein said electronic circuit operates said second electrode, wherein said second electrode is connected to said top conductive layer.

3. The compression post CMUT of claim 1, wherein said top conductive layer comprises i) a transmit electrode, ii) a receive electrode, or i) and ii).

4. The compression post CMUT of claim 3, wherein said transmit electrode comprises a transmit electrode gap between said transmit electrode and said moveable mass, wherein said receive electrode comprises a receive electrode gap between said receive electrode and said moveable mass, wherein said transmit electrode gap is larger than said receive electrode gap.

5. The compression post CMUT of claim 1, wherein an electronically insulating layer is disposed on said bottom surface of said moveable mass, wherein said electronically insulating layer is disposed between said compression post and said movable mass.

6. The compression post CMUT of claim 1, wherein an electronically insulating layer is disposed on a bottom surface of said compression post.

7. The compression post CMUT of claim 1, wherein said compression post has a lower stiffness than said moveable mass, a higher stiffness than said moveable mass, or the same stiffness as said moveable mass.

8. The compression post CMUT of claim 1, wherein said top conductive layer comprises a device layer of a silicon on insulator (SOI) wafer, wherein said SOI comprises a handle layer, an insulating layer and said device layer.

9. The compression post CMUT of claim 8, wherein said handle layer comprises an electronic circuit, wherein said electronic circuit operates said first electrode connected to said movable mass, wherein said electronic circuit operates said second electrode connected to said device layer.

10. The compression post CMUT of claim 8, wherein said device layer comprises an electronic circuit, wherein said electronic circuit operates said first electrode connected to said movable mass, wherein said electronic circuit operates said second electrode connected to said device layer.

11. The compression post CMUT of claim 1, wherein said top conductive layer comprises said second electrode.

12. The compression post CMUT of claim 1, wherein said moveable mass comprises a plate having a pattern of features disposed therein or pattern of features disposed thereon.

13. The compression post CMUT of claim 1, wherein said compression post has a cross-section shape selected from the group consisting of a circle, a circle with varying thickness along the length of said compression post, a ring, an oval, a hollow oval, a polygon, a hollow polygon, a cross, and a rectangle.

14. The compression post CMUT of claim 1 further comprises a comb drive, wherein said comb drive comprises a plate connected normal to said bottom surface of said movable mass, wherein said plate is disposed in a trench formed in said top conductive layer, wherein said plate is separated from said top conductive layer by a plate gap within said trench.

15. The compression post CMUT of claim 1, wherein said top conductive layer comprises a pattern of secondary post holes, wherein a pattern of secondary compression posts are disposed in said secondary post holes.

16. The compression post CMUT of claim 15, wherein said secondary compression posts have a length spanning from a bottom of said secondary post holes to within said operating gap.

17. The compression post CMUT of claim 15, wherein said secondary compression posts have a length spanning from a bottom of said secondary post holes to a moveable mass cavity disposed in a bottom surface of said movable mass.

18. The compression post CMUT of claim 1, wherein said movable mass comprises another said compression post CMUT disposed thereon, or an electronic device disposed thereon or therein.

19. The compression post CMUT of claim 1 further comprises a bottom conductive layer, wherein said bottom conductive layer is electronically insulated from said top conducting layer, wherein said bottom conductive layer comprises an electronic circuit, wherein said electronic circuit operates said first electrode connected to said movable mass, wherein said electronic circuit operates said second electrode connected to said top conductive layer.

20. The compression post CMUT of claim 1, wherein said top conductive layer comprises an electronic circuit, wherein said electronic circuit operates said first electrode connected to said movable mass, wherein said electronic circuit operates said second electrode connected to said top conductive layer.

* * * * *